United States Patent [19]

Novinger

[11] 4,430,768

[45] Feb. 14, 1984

[54] AGITATOR STRUCTURE FOR SUCTION CLEANERS

[76] Inventor: Harry E. Novinger, 4961 S. Chester St., Englewood, Colo. 80111

[21] Appl. No.: 361,394

[22] Filed: Mar. 24, 1982

[51] Int. Cl.[3] ..... A47L 5/30

[52] U.S. Cl. ..... 15/381; 15/375; 15/386

[58] Field of Search ..... 15/366, 370, 381, 383, 15/386, 375

[56] References Cited

U.S. PATENT DOCUMENTS

| | | | |
|---|---|---|---|
| 1,742,375 | 1/1930 | Bass | 15/366 X |
| 1,773,961 | 8/1930 | Dance | 15/381 X |
| 2,008,371 | 7/1935 | Smellie | 15/366 X |
| 2,045,270 | 6/1936 | Hoover | 15/366 X |
| 2,085,700 | 6/1937 | Kitto | 15/366 X |
| 2,268,429 | 12/1941 | Shank | 15/366 |
| 2,310,267 | 9/1943 | Taylor | 15/366 X |
| 3,225,374 | 12/1965 | Daley et al. | 15/366 X |

*Primary Examiner*—Chris K. Moore

[57] ABSTRACT

Agitator restrictor structure in combination with a revolving or a reciprocating type sweep drive is located close to the nozzle mouth in a suction cleaner by providing a cavity in the agitator structure for recessing the major portion of the cleaning brush to retain the designed bristle tuft lengths. In this location, the agitator structure restricts and changes the shape of the airstream at the nozzle opening to increase its speed, resulting in greater cleaning efficiency.

7 Claims, 7 Drawing Figures

AGITATOR STRUCTURE FOR SUCTION CLEANERS

BACKGROUND OF INVENTION

The field of the invention relates to suction cleaners often called vacuum cleaners and more particularly to those with agitators. The field also includes both rotating types, revolving and reciprocating, as are designed for cleaning floors and other surfaces whether smooth or of indefinite surface depth.

All known prior art with rotatable agitators employ nozzles with large area mouths. As in typical nozzle mouths, this invention has a rectangular nozzle mouth and contains a rotating agitator roll equipped with at least one brush strip. U.S. Pat. Nos. 2,734,211 and 2,734,212 are typical of the prior art.

In the prior art the length of the brush bristle tufts determine the distance the agitator roll is located above the plane of the mouth margins and also determines the size of the airstream flow patterns about both sides of the agitator roll, as it is ducted between the agitator roll and the mouth margins. These cross-sections of the airstream between the agitator roll and the nozzle margins are usually 10 square inches compared to the usual 1.5 square inches cross-section of the downstream air passageway through which the same air must pass enroute to the dust bag. This passageway constriction results in a very slow air flow speed across the nozzle mouth and across the surface to be cleaned. Along with the slow speed is a low differential air pressure drop across the surface to be cleaned resulting in known inefficient cleaning effectiveness.

These low air speeds at the nozzle mouth results in uneven speeds across the portions of the nozzle mouth farthest from the mouth of the much smaller passageway immediately downstream of the nozzle mouth. These different flow speeds in different portions of the nozzle mouth result in areas of the surface being cleaned being less clean than adjacent areas. None of the art has shortened standard tuft lengths so as to operate agitators closer to the nozzle mouths, a length certain to abrade surfaces and decrease brush efficiency while causing the brush to rapidly wear out.

It is also known that much of the prior art has attempted to compensate for this cleaning deficiency by increasing the motor size for more airstream flow speed and more agitator roll revolving speed, and by decreasing the size of the internal geometry of the passageway mouth behind the agitator roll; the first resulting in a very heavy cleaner and the second in easy clogging of the mouth of the passageway. The weight has further resulted in powered traction assistance for moving the heavy cleaner over floor surfaces to be cleaned. The big motors and fast agitator roll speeds have also resulted in unnecessary wear of carpeting and the still too low air pressure differential fails to lift the heavier particles and certain other materials from shag-type carpeting that a higher pressure differential would better clean.

None of the known prior art has produced, invented, suggested or recognized the need of structure for restricting and changing the dimensions of the cross-sectional areas of the airstreams between both agitator roll sides and the nozzle mouth margins as a method for increasing efficiency, or of structure for providing at least one cavity in the agitator roll for recessing the major portion of at least one brush strip in the agitator roll so that the roll could be rotated in closer proximity to the margins of the nozzle mouth without modifying standard brush designs as does this invention.

SUMMARY OF THE INVENTION

The invention provides greatly increased cleaning efficiency through use of rotatable airstream restrictive agitator structure that rearranges the cross-sections of the airstream flow patterns at the two sides of the agitator roll into long slender rectangles. When this novel agitator structure is located close to the nozzle mouth margins, the result is a suction cleaner body effectively having slit-like openings approximate the mouth of the nozzle for increasing the airstream flow speed across the adjacent surface to be cleaned.

The basic differences between this invention and the prior art are: The agitator roll contains structure for recessing and mounting at least one standard designed brush strip so that the brush bristle tuft ends, that do the sweeping or cleaning, do not contact the nozzle mouth margins or dig too deep into the surface to be cleaned when the agitator roll is located to operate close to the mouth margins. In this position, the agitator roll decreases and reshapes the cross-sectional size of the airstream at each side of the roll so as to increase its otherwise slow flow speed, thereby increasing the pressure differential across the surface to be cleaned and increasing what is commonly termed suction. This cross-section of the airstream is now shaped as two very narrow rectangles with their lengths determining the width of the strip of surface being cleaned and the rectangle width being the narrow dimension and about $\frac{1}{4}$ inch or less instead of about $\frac{1}{2}$ inch as in the prior art. This results in about 100% increased cleaning efficiency and other advantages. This novel brush strip recessing structure permits the agitator roll to take the form of a cylindrical shell or a solid depending on design of internal brush cleaning air ducts as will be seen.

As the agitator, now located close to the nozzle mouth, may be rotated slower because it is about twice as efficient, a reciprocating or alternating sweep movement of the brush is practical in addition to the usual revolving movement through 360 degrees in one direction. The reciprocating movement further increases carpet cleaning efficiency because it separates the pile better than the one direction rotation movement.

This agitator roll rotatable airstream restricting structure or air baffle structure is adaptable to novel mounting of the cleaning brush strip permitting a miniature agitator roll more versatile in operations than known in the prior art. It cleans under one inch high mounted wall type heat exchangers and certain other low-set objects under which bigger agitators are impractical for cleaning.

The agitator roll is preferred to operate relative the nozzle mouth margins whereby the plane, defined by the majority of the mouth margin surfaces, is tangent to the cylinder formed by the agitator roll outer most structural portions in rotation. The agitator roll may, when required, be adjusted to operate close above or below this plane of the nozzle mouth but much closer than the prior art can operate.

This structure provides for full standard length brush tufts to be recessed as necessary to eliminate any need for cutting them. The structure is easily adaptable to automatic adjustment of the short brush strip portion extending exterior the cavity sides. The reciprocating movement combined with a cleaning strip of a plasticlike material, replacing the customary brush strip, cleans carpeting in an efficient manner. It is for maintaining the cleaning strip resiliency that the cavity is required so that the standard brush strip's ability to whisk is not diminished by shortening its tufts when lowering the agitator roll as an alternate attempt at increasing efficiency.

The primary object of this invention is to provide structure to increase the cleaning ability of agitator-type suction cleaners while decreasing their much too heavy weight, while decreasing their body height, and while decreasing their high cost, their excessive wear on the surface being cleaned and their energy consumption.

Other objects are to provide structures for improved utility as in miniaturization of the body to decrease or eliminate the need for special cleaning attachments and the need for wheels or rollers to support the body.

DESCRIPTION OF THE DRAWINGS

Other objects and advantages of the present invention will be apparent to those skilled in the art from the following description with reference to the appended claims wherein like members denote like parts and wherein:

DETAILED DESCRIPTION OF INVENTION

Figure 1:
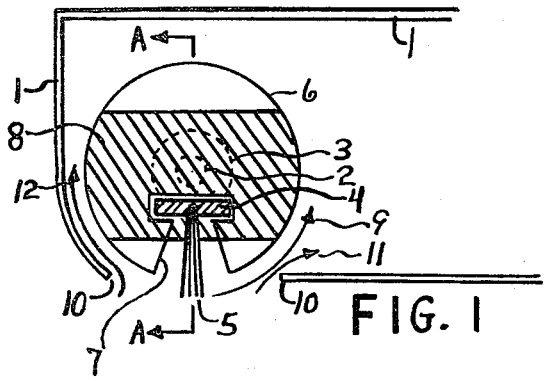
FIG. 1 shows more or less a diagrammatic and schematic end view of a suction cleaner body and an agitator roll structure for rotation through 360 degrees and the basic cavity structure for recessing the cleaning brush strip.

FIG. 1 shows the basic cleaning strip recessing structure which is the main structure making this invention an improvement over the prior art. Part 1 is a suction cleaner body to which agitator roll axle 2 is rotatably fixed with suitable bearings at each of its two ends. Substantially centered about axle 2 is agitator roll 6 which is a cylindrically shaped shell and of any fairly rigid and suitable material. It may also take the form of a solid with a cavity therein to freely recess and secure in any manner desirable the inner major portion of brush strip 4-5; 4 being the brush strip back secured by the sides of roll 6 when extended in toward the axis to form cavity 7 and further extended to form the slot about brush back 4.

Cavity 7, for recessing the brush may be coplanar with the roll axis or may be of a long pitch helix about the roll axis. For simplicity, the helical alignment is not shown. Extending out of brush strip back 4 are bristle tufts 5. The outer ends of tufts 5 are the cleaning ends. Only the cleaning ends extend beyond the cavity and beyond the cylinder, made by the outer portions of the agitator roll when rotated. The cavity provides a slot like opening big enough to allow tufts 5 to freely extend and flex while cleaning.

Roll 6 is fixed at both ends to end plates 8. One or both end plates may be detachably fixed to allow brush back 4 to slide in its retaining slot. End plates 8 are fixed to axle 2. Power to axle 2 is delivered through pulley 3. Arrow 9 shows the cylinder surface formed by the outer cleaning end of tufts 5. This cylinder surface in its lowest arc, where tufts 5 are shown in this FIG., normally lies below the nozzle mouth opening by about 3/16 inch in most operations.

The unique brush strip structure of this invention provides for use of standard length brush tuft bristles that give good results while at the same time providing airstream restriction structure that greatly reduces the airstream cross-section approximate the plane of the nozzle margins 10—10. Arrow 11 shows the airstream direction and at its most narrow cross-sectional dimension continued between margin 10 and roll 6. A similar sized airstream on the other side of roll 6 is shown by arrow 12 confined between body 1 and roll 6. Thus, the cavity permits the operation of roll 6 closer to the nozzle mouth than the prior art for decreasing the airstream area, thereby increasing its speed, across the surface to be cleaned, resulting in increased differential air pressure drop across that surface for increased cleaning efficiency.

Figure 3:
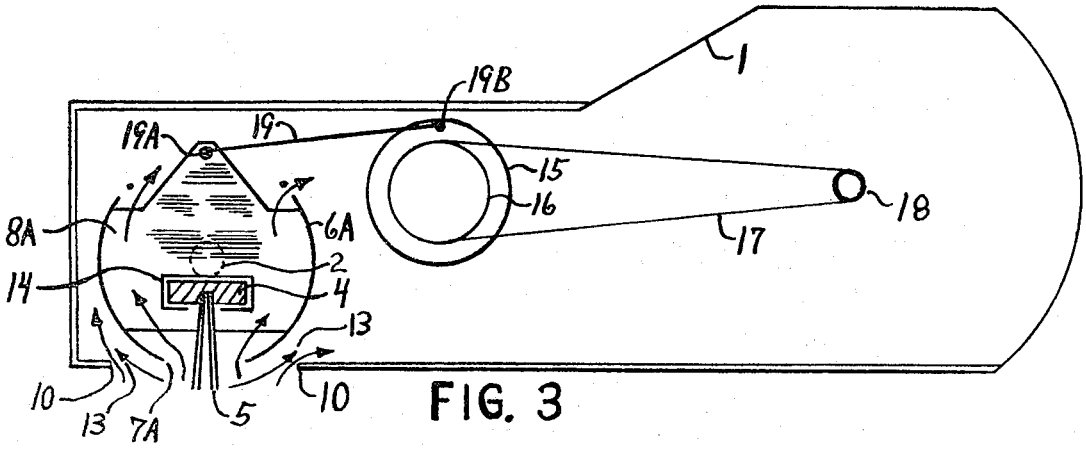
FIG. 3 is a similar type drawing of a second embodiment of agitator roll structure similar to FIG. 1, except for the cleaning brush strip being recessed in a cavity formed by the margins of the agitator roll and except for a reciprocating type of rotary movement.
Figure 5:
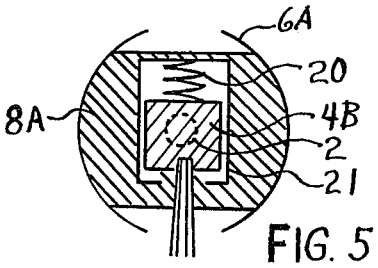
FIG. 5 is a similar type drawing of a fourth embodiment of agitator roll structure similar to FIGS. 1 and 3, except for automatic adjustment structure of length of the cleaning brush strip tufts when the outer portion is in contact with the surface being cleaned.

When agitator roll 6 is a shell instead of a solid, ports may be cut in the cavity walls along each side of tufts 5 and as required in the opposite side areas of roll 6 to allow small airstreams to flow through the roll for cleaning the tufts, as will be shown in FIGS. 3 and 5.

Figure 2:
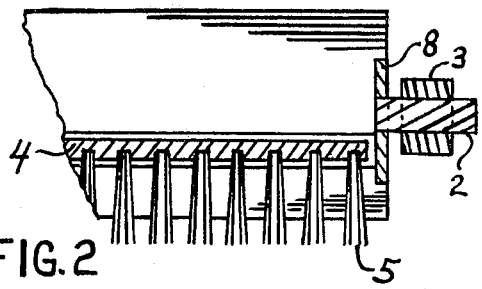
FIG. 2 is a similar type drawing of the side view of the powered end of FIG. 1.

FIG. 2 is a side view cross-section of FIG. 1 taken on line A—A and showing only the drive end of the agitator; in this case, the drive is by belt driven pulley 3 fixed to axle 2.

FIG. 3 shows the general structure of a shell version of FIG. 1 structure providing two small airstreams designated by four arrows showing the airstreams passing through the nozzle mouth, thence into the hollow agitator roll 6A via its lower wall opening acting as a vent or port 7A, thence passing both sides of brush 4 to exit the roll through its top opening for air cleaning of brush bristle tufts 5. Brush back retaining bracket 14 encloses and fixes brush back 4; bracket 14 is fixed at its ends to roll end plates 8A. This drawing also shows reciprocating movement structure as another rotary type movement between arc limits 13—13. This arc also is the arc made by the tips of the tufts 5 cleaning ends in its short reciprocating or alternating sweep. This arc is preferred to terminate above the plane of the nozzle mouth at 13—13 on each sweep so as to momentarily free the tufts from the surface being cleaned for optimal cleaning. 7A is the port defining the cavity recessing tufts 5.

A single rod and wheel reciprocating structure is shown, as representative of the various such structure available for use. Wheel 15 is driven by belt pulley 16 through belt 17 and power source shaft 18 which may be electric motor or airstream motor. Rod 19 is rotatably fixed to wheel 15 on one end plate 8A at pivots 19A and 19B for actuating agitator roll 6A in its reciprocating movements. This type sweep has been found to efficiently raise and spread the pile and clean long carpet pile when the fibers of the pile are lying down in one general direction, a condition that is often found and not satisfactorily corrected when using 360 degree rotating agitator rolls especially when the direction of rotation is that of the fibers.

Figure 4:
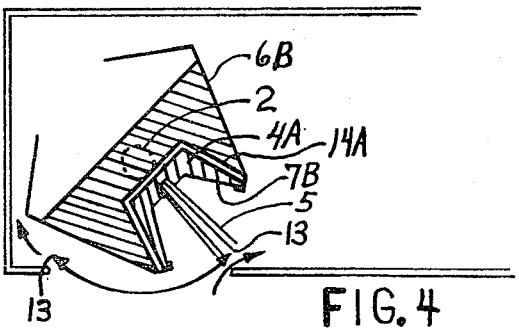
FIG. 4 is a similar type drawing of a third embodiment of agitator roll structure similar to the earlier FIGS. except for the cleaning brush strip being recessed in a cavity formed by margins of flat members rather than the curved sides as in FIG. 3 and a different brush back 4A.

FIG. 4 shows an agitator roll in a reciprocating movement at the end of its sweep at arrow 13. This agitator is much like the agitator in FIG. 3, except for its flat sides. The outer portions of these agitator roll sides 6B also rotate in cylindrical arcs and while rotating do not raise or agitate short tufted carpeting but do raise bent tufts of long tufted carpeting to create great agitation of shag carpeting. Brush back 4A is a recessed type structure wherein the sides of the strip back are shaped as projections forming the cavity sides 7B. Bracket 14A fixes 4A.

FIG. 5 shows an agitator roll with similar structural and operational characteristics, as earlier described, except for this automatic recess adjustment of the brush strip tufts. This adjustment is actuated by the surface being cleaned when it places a force against the tufts different than the reacting tension of springs 20. Spring 20 is designed to possess enough tension to push brush back 4B by an amount sufficient to maintain position of the brush tufts of the brush in contact with variable heights and densities of carpeting tufts so as to clean the carpeting. Similarly, when the brush tufts become worn in length, softened by use or the surface being cleaned is of a texture more easily penetrated than normal, the spring tension is responsive to both the brush and the carpet surface variations whereby normal cleaning is maintained by automatic adjustment of the amount of brush recession. A slowing or increase in the rotary rate of the agitator roll may also affect the amount of brush tuft recession when the relative location of the mass of brush back 4B to the axis of roll 6A and spring tension is designed to be affected by centrifugal off-center forces. For this reason, brush back 4B is normally fabricated to be of light weight and located approximate the axis of the roll as shown. Brush back 4B is retained by guide 21 which is fixed to end plates 8A.

Figure 6:
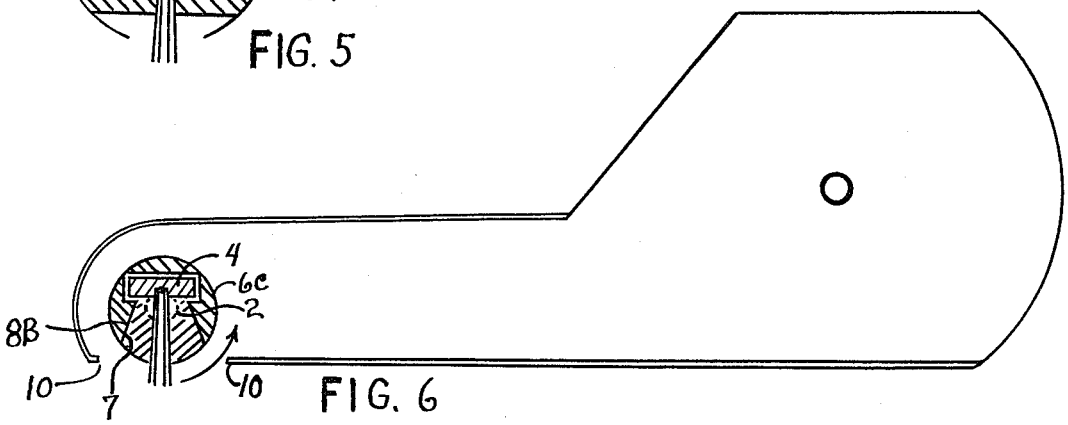
FIG. 6 is a similar type drawing of a fifth embodiment of agitator similar in design and function to the other drawings, except for the cleaning brush strip being recessed in a cavity formed deep in the agitator at the inner and opposite wall and opposite side of the axis from the cleaning brush strip tufts normally exposed for cleaning, and this structure resulting in a miniature sized agitator roll when the standard sized brush strip, as used in the other FIGS., is mounted by this method.

FIG. 6 is a miniature sized agitator roll 6C structure of FIG. 1, wherein brush back 4, of standard size, is fixed deep within the opposite side of roll 6C on the opposite side of the roll axis to that of the brush tufts cleaning ends. Miniaturization provides versatile use not available in bigger units. Its size, light weight and flat lower surface in contact with the surface to be cleaned allows easy glide without use of wheels or rollers.

The axles 2 may not extend the length of the axis in this agitator as the tufts lie there. End plates 8B may be circular disks as shown or may have areas only big enough to fix axles 2 to the agitator roll which may be a shell or solid 6C structure.

Figure 7:
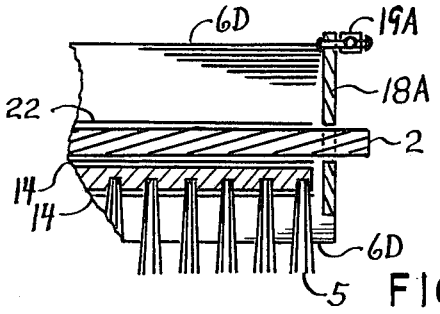
FIG. 7 is a similar type drawing of a sixth embodiment of agitator roll structure more similar to FIG. 3 but adaptable to FIG. 1 and except either of the margins of the agitator roll sides, forming the margins of the cavity for recessing the cleaning brush strip, may directly drive the brush strip by bearing against the outer end of the tufts.

FIG. 7 is a side view of the driven end of an agitator roll 6D similar to roll 6A in FIG. 3 except for different cleaning brush actuating structure. In this structure, the lower margins of roll 6D bear against one side of the brush strip for rotation. Brush back 4 is retained in place by bracket 14, as end view FIG. 3 shows, except here the bracket 14 is rotatably fixed to axle 2 by member 22 for independent movement of bracket 14 relative the other members; but independent only until one or the other lower side margins of roll 6D bears on the tufts causing rotation of the brush strip about the agitator axis. Roll 6D here is shown driven by pivot 19A fixed to end plate 8A fixed to 6D. This drive structure provides use of standard brush strip tufts 5 in industrial applications when domestic tuft resiliency is not stiff enough for adequate cleaning, this direct-drive pressure close to the tips of the cleaning ends of the tufts decreases their flection for greater stiffness.

While the invention has been described and shown in its preferred embodiments, it will be clear to those skilled in the arts to which it pertains that many changes and modifications may be made thereto without departing from the scope of the invention.

I claim:

1. In a suction cleaner body, rotatable agitator means therein, a power supply for rotating the agitator means, an airstream nozzle with mouth margins defining a plane, and the agitator means comprising;

at least one cleaning strip having a back portion and a cleaning portion for contacting a surface to be cleaned;

an agitator roll;

means for carrying the cleaning strip in the agitator roll;

means for rotatably connecting the agitator roll to the cleaner body;

means for rotatably actuating the agitator roll in a reciprocating movement; and the agitator roll having portions of its surface defining a cylinder when rotated; and, the means for carrying the cleaning strip including cavity means for recessing the majority of the cleaning strip within the cylinder defined by the agitator roll when rotating, a walled shell in cross section disposed so as to define the outer dimension of the agitator roll, the shell having margins forming a first slot-like opening and a second slot-like opening, the first opening defining a portion of a cavity in which the cleaning strip is recessed, and the two openings providing ports for passage of air through the roll for cleaning the cleaning strip, and the agitator roll positioned relative the nozzle mouth margins so that the nozzle mouth plane is substantially tangent to the cylinder of the roll, for restricting the area of the nozzle mouth to arrange the airstreams into more effective shapes causing high speeds and pressure differentials across the surface to be cleaned for efficient cleaning.

2. In a suction cleaner having a power source, a body comprising; a nozzle with mouth margins defining a plane;

at least one cleaning strip for contacting the surface to be cleaned and the strip having a cleaning portion with projecting extensions;

an agitator roll positioned close to the nozzle mouth margins;

means for rotatably connecting the agitator roll to the body and to the power source for rotating the agitator on its axis, and, the agitator roll includes a roll body that is a solid in cross section with a cavity penetrating the solid for recession of the cleaning strip therein and means for locating the base of the cleaning strip back in the agitator roll opposite the roll axis to the location of the cleaning portion of the strip; and, means for recessing and mounting the cleaning strip relative the agitator roll so that the projecting extensions form cavity side walls recessing the major portion of the cleaning strip within the cylinder defined by rotation of the agitator roll, and the lower arc of this cylinder located substantially even with the plane defined by the mouth margins so that the surfaces of the roll will decrease the cross sectional area of the airstream substantially at the nozzle mouth thereby increasing the flow speed and the cleaning efficiency compared to rolls positioned farther from the margins.

3. In a suction cleaner body, rotatable agitator means therein, a power supply for rotating the agitator means, an airstream nozzle with mouth margins defining a plane, and the agitator means comprising;

at least one cleaning strip having a back portion and a cleaning portion for contacting a surface to be cleaned;

an agitator roll;

means for carrying the cleaning strip in the agitator roll;

means fo rotatably connecting the agitator roll to the cleaner body and the agitator roll having portions of its surface defining a cylinder when rotated; and, the means for carrying the cleaning strip including cavity means for recessing the majority of the cleaning strip within the cylinder defined by the agitator roll when rotating, a walled shell in cross section disposed so as to define the outer dimension of the agitator roll, the shell having margins forming a first slot-like opening and a second slot-like opening, the first opening defining a portion of a cavity in which the cleaning strip is recessed and the two openings providing ports for passage of air through the roll for cleaning the cleaning strip, the agitator roll is miniature in size being so small the cleaning strip and the cavity means occupy the majority of its volume, and the means for carrying the cleaning strip includes fixing the strip back at the opposite side of the roll axis to that of the cleaning portion of the strip, and the agitator roll positioned relative the nozzle mouth margins so that the nozzle mouth plane is substantially tangent to the cylinder for restricting the area of the nozzle mouth to arrange the airstreams into more effective shapes causing high speeds and pressure differentials across the surface to be cleaned for efficient cleaning.

4. In a suction cleaner body, rotatable agitator means therein, a power supply for rotating the agitator means, an airstream nozzle with mouth margins defining a plane, and the agitor means comprising;

at least one cleaning strip having a back portion and a cleaning portion for contacting a surface to be cleaned;

an agitator roll;

means for carrying the cleaning strip in the agitator roll;

means for rotatably connecting the agitator roll to the cleaning body and the agitator roll having portions of its surface defining a cylinder when rotated; and, the means for carrying the cleaning strip including cavity means for recessing the majority of the cleaning strip within the cylinder defined by the agitator roll when rotating, a walled shell in cross section disposed so as to define the outer dimension of the agitator roll, the shell having margins forming a first slot-like opening and a second slot-like opening, the first opening defining a portion of a cavity in which the cleaning strip is recessed, a margin of the shell bears against a side of the cleaning strip for driving the strip, and the two openings providing ports for passage of air through the roll for cleaning the cleaning strip, and the agitator roll positioned relative the nozzle mouth margins so that the nozzle mouth plane is substantially tangent to the cylinder for restricting the area of the nozzle mouth to arrange the airstreams into more effective shapes causing high speeds and pressure differentials across the surface to be cleaned for efficient cleaning.

5. In a suction cleaner body, an airstream nozzle having mouth margins defining a plane, and an agitator rotatably fixed in the body close to the nozzle mouth margins and comprising; at least one cleaning strip with back and cleaning portions; and, an agitator roll with portions of its surface defining a cylinder when rotating and means fixing the back portion of the strip to the roll so as to be located substantially at a first side of the cylinder and the cleaning portion located to penetrate a second side of the cylinder defined opposite of the roll axis to the first side, and the cylinder having its lower arc substantially even with the plane of the mouth so that the agitator roll restricts the area of the nozzle mouth to form at least one narrow slit-like opening through which the airstream flows at increased speed with respect to the flow of a lesser restricted nozzle mouth for increasing the suction at the surface to be cleaned for increased cleaning efficiency in proportion to amount of restriction.

6. In a suction cleaner body, an airstream nozzle having mouth margins defining a plane, and an agitator rotatably fixed in the body close to the nozzle mouth margins and comprising;

at least one cleaning strip with back and cleaning portions; and, an agitator roll with portions of its surface defining a cylinder when rotating and means fixing the back portion of the strip to the roll so as to be located substantially at a first side of the cylinder and the cleaning portion located to penetrate a second side of the cylinder defined opposite of the roll axis to the first side, means for rotatably actuating the agitator roll in a reciprocating movement, and the cylinder having its lower arc substantially even with the plane of the mouth so that the agitator roll restricts the area of the nozzle mouth to form at least one narrow slit-like opening through which the airstream flows at increased speed with respect to the flow of a lesser restricted nozzle mouth for increasing the suction at the surface to be cleaned for increased cleaning efficiency in proportion to amount of restriction.

7. The invention of claim 1, or 5, wherein; a cleaning strip guide is fixed on the agitator roll, and means for retaining the back portion of the cleaning strip within the guide, a spring, and means for fixing the spring to the roll and to the strip back so that spring tension automatically adjusts recession of the strip cleaning portion relative the roll when changes occur in the surface being cleaned or in the strip cleaning portion.

* * * * *